United States Patent [19]

Borruso

[11] 4,199,417

[45] Apr. 22, 1980

[54] ELECTRODEPOSITION OF BLACK DEPOSIT AND ELECTROLYTES THEREFOR

[76] Inventor: Mariano Borruso, 746 McDonald Ave., Brooklyn, N.Y. 11218

[21] Appl. No.: 960,161

[22] Filed: Nov. 13, 1978

[51] Int. Cl.[2] ..... C25D 3/56

[52] U.S. Cl. ..... 204/44; 106/1.22; 106/1.23; 204/43 R; 204/43 Z; 204/43 T

[58] Field of Search ..... 204/43 R, 43 Z, 43 T, 204/44, 45 A, 123; 106/1.22, 1.23

[56] References Cited

U.S. PATENT DOCUMENTS

| | | | |
|---|---|---|---|
| 1,042,533 | 10/1912 | Daft | 204/44 |
| 1,120,794 | 12/1914 | Daft | 204/44 X |
| 2,732,336 | 1/1956 | Ostrow | 204/44 X |
| 2,750,333 | 6/1956 | Smart | 204/43 R |
| 2,823,176 | 2/1958 | Breining et al. | 204/45 A |

FOREIGN PATENT DOCUMENTS

| | | | |
|---|---|---|---|
| 1258234 | 1/1968 | Fed. Rep. of Germany | 204/43 T |
| 11543 | of 1911 | United Kingdom | 204/44 |

OTHER PUBLICATIONS

Lawrence E. Stout et al., The Electrochemical Soc., Preprint 63-3; pp. 17-37, (1933).

Abner Brenner, "Electrodeposition of Alloys," vol. II, pp. 560-566, (1963).

*Primary Examiner*—G. L. Kaplan

*Attorney, Agent, or Firm*—Hammond & Littell, Weissenberger and Muserlian

[57] ABSTRACT

Aqueous alkaline bath composition for electroplating a black metallic co-deposit on ferrous and non-ferrous substrates comprised of an antimony-containing compound; a copper, nickel or zinc compound, and a strong base.

20 Claims, No Drawings

ELECTRODEPOSITION OF BLACK DEPOSIT AND ELECTROLYTES THEREFOR

This invention relates to electroplating and more particularly relates to the electroplating of metallic deposits on ferrous and non-ferrous metals from alkaline solutions.

An object of this invention is to provide a novel composition and process for electroplating a deposit which is black in color and which has the capability of filling imperfections in the base metal being coated.

Further objects of this invention are to provide a finish range of dull, semi-bright and bright which is hard, wear resistant, hard scratch resistant and can be used for antique finish over ferrous or non-ferrous parts or for a lustrous or semi-lustrous high leveled, corrosive resistant uniform deposit that can take much wear and still retain an aesthetic appeal.

The invention is a new black electroplating bath composition and method.

It is found that an alkaline solution containing antimony oxide and sodium hydroxide will electrodeposit a coating that is black in color. But the nature of this deposit is very coarse. The deposition can be controlled by adding another metal and the co-deposit of antimony with that metal. Specifically, antimony will co-deposit with copper from a solution of copper cyanide, sodium hydroxide and antimony oxide.

EXAMPLE 1

A steel panel was plated using the following solution in a Hull test cell under the following conditions:

| | Approximately |
|---|---|
| Temperature | 85° F. |
| Voltage | 2 volts |
| Current density | 80–1 amps/sq.ft. |
| Copper cyanide | 1.0 oz/gallon |
| Sodium cyanide | 1.7 oz/gallon |
| Caustic Soda | 8.0 oz/gallon |
| Antimony Oxide | 1.0 oz/gallon |

Different concentrations of metal will plate out at different current density ranges. The antimony that is deposited in the current density range of 35-10 amps/sq.ft. produces a hard black surface.

A solution which will provide a uniform deposit suitable as an antique finish over a bright substrata can be obtained by adding approximately 0.025 oz/gallon of potassium telluride.

EXAMPLE 2

| | Approximately |
|---|---|
| Copper Cyanide | 1.0 oz/gallon |
| Sodium Cyanide | 1.7 oz/gallon |
| Caustic soda | 8.0 oz/gallon |
| Antimony oxide | 1.0 oz/gallon |
| Potassium telluride | .025 oz/gallon |
| Current | 2.0 amps |
| Current density range | 80–1 amp/sq.ft. |
| Temperature | 85° F. |
| Voltage | 2.0 volts |

The current density range of 70-10 amps/sq.ft. results in the best hard and fine grain deposit. This is a uniform deposit particularly suited as an antique finish over a bright substrate.

An electrodeposit which is protective as well as black when plated over steel is as follows:

EXAMPLE 3

| | Approximately |
|---|---|
| Zinc oxide | 1.0 oz/gallon |
| Caustic soda | 8.0 oz/gallon |
| Antimony oxide | 1.0 oz/gallon |
| Voltage | 1.0 volts |
| Current density range | 40–.5 amps./sq.ft. |
| Temperature | 80° F. |

This results in a black co-deposit of zinc and antimony best in the current density range of 35-20 amps/sq.ft.

To obtain a fine grain deposit but black in color over the entire range commercially, the following may be used.

EXAMPLE 4

| | Approximately |
|---|---|
| Zinc oxide | 1.0 oz/gallon |
| Caustic soda | 8.0 oz/gallon |
| Antimony oxide | 1.0 oz/gallon |
| Polyethylene glycol | .05 oz/gallon |
| Temperature | 80° F. |
| Current density range | 40–.5 amps/sq.ft. |
| Voltage | 1.25 volts |

This will produce a protective black deposit over ferrous and non-ferrous metals and will immersion plate over an aluminum substrate. A further advantage is that the deposit will not form a dielectric film and will be conductive to applications where electric properties are desired. In the present state of the art a black coating over a zinc surface generally requires the use of heavy chromate coatings that cause a dielectric film which has to be removed before electrical contact can be made to the substrate.

A small amount of nickel included in a cyanide solution will plate out less readily but will cause a harder deposit. This deposit will be wear resistant when applied to a substrate of ferrous or non-ferrous metal and will give a black electrodeposit that is hard scratch resistant.

EXAMPLE 5

| | Approximately |
|---|---|
| Nickel cyanide | 0.5 oz/gallon |
| Sodium cyanide | 0.5 oz/gallon |
| Sodium hydroxide | 8.0 oz/gallon |
| Antimony oxide | 1.0 oz/gallon |
| Temperature | 85° F. |
| Current density range | 80–.5 amps/sq.ft. |
| Voltage | 2–3 volts |

The solution will give a hard scratch resistant surface that will brighten when the solution is agitated. The deposit is uniform in color and gives a uniform deposit over the entire current density range from 80-0.5 amps/sq.ft. The coating is applicable as an antique finish over ferrous or non-ferrous parts and is wear resistant.

Variations on the above examples have special helpful effects as follows.

In the solutions of Examples 1 and 5 additions of:

| | Approximately |
|---|---|
| Tellurium (Potassium Telluride) | .025 oz/gallon allows uniform deposits and a finer grain deposit |
| Selenium (Selenium Dioxide) | .0125 oz/gallon causes a smoothing out of the deposit in a wide current density range of 80–20 amps/sq.ft. |
| Lead (Lead Subcarbonate) | Up to .5 oz/gallon causes a brightening of the deposit |

The nickel in the solution of Example 5 seems to enhance the brightening effects when the above additives are included.

In addition to these metallic ion additions, the following organics will brighten the black deposit:

A. A quaternary condensate of the reaction of Nicotinamide and Epichlorohydrin;

B. The reaction production from a mixture of Polyethylene Imine of molecular weight 600 and Vanillan (3 Methoxy -4 Hydroxy Benzaldehyde) which is mixed in a vessel and held at 200° F. for approximately 4 hours;

C. Proparyl Alcohol (2-propyn-1-ol); or

D. A substituted Imidazoline type surfactant.

Examples of the manner of their use are as follows:

To the solutions of Example 1 and Example 5:

| | Approximately |
|---|---|
| Organic (a) | .3 oz/gallon |
| Reaction product (b) | .17 oz/gallon |
| Organic (c) | .001 oz/gallon |
| Tellurium | .025 oz/gallon |
| $As_2O_3$ | .025 oz/gallon |

At current density range 80-60 amps/sq.ft. the deposit resulting is semi-bright; at 60-20 bright; and at 20-2 dull. The addition of the Tellurium gives a more uniform deposit of finer more closely packed grain structure. The use of approximately 0.025 oz/gallon of arsenic as $As_2O_3$ hardens the deposit and results in a semi-bright finish. The reaction product (b) in approximately 0.17 oz/gallon gives a lusterous deposit.

If approximately 2.0 oz/gallon of propargyl alcohol is added to the solutions in Examples 1 and 5, in the current density range of 100-24 amps/sq.ft. the deposit is very bright. The propargyl alcohol seems to cause a synergetic reaction when used with the other organic compounds.

Adding to the solution of Example 4,

| | Approximately |
|---|---|
| Organic (a) | .3 oz/gallon |
| Reaction product (b) | .17 oz/gallon |
| Organic (c) | .001 oz/gallon |

gives bright results in the current density range 40-20 amps/sq.ft.; semi-bright from 20-3 and dull below 3. Propargyl alcohol has little effect on this solution. Use of these additions to the solutions of the Examples permits one to work the solutions at higher current density ranges with more uniform results and better properties. Substrate plated out are highly scratch resistant and product plated can take much wear and the brightness remain. The addition to Example 4 results in a corrosive resistant uniform and bright deposit.

A commercially available polyethylene glycol of molecular weight 1500 suitable for use in this invention is made by Union Carbide Corporation under the trade name "Carbowax".

A suitable quaternary condensate of the reaction of nicotinamide and epichlorohydrin is manufactured by the Napera Chemical Company of Harriman, New York, under the trade name "PAMOC".

A substituted imidazoline type surfactant is manufactured by the Lonza Company under the trade name "Amphoterge K".

Having fully described the invention, I claim as follows:

1. An aqueous alkaline bath composition for electroplating a black metallic co-deposit on a platable substrate, comprising, in solution, about 1.0 oz/gallon of antimony oxide, about 1.0 oz/gallon of copper cyanide, about 1.7 oz/gallon of sodium cyanide, and about 8.0 oz/gallon of sodium hydroxide.

2. The composition of claim 1 comprising in addition about 0.025 oz/gallon of potassium telluride, about 0.0125 oz/gallon of selenium dioxide, up to about 0.5 oz/gallon of lead subcarbonate, about 0.025 oz/gallon of arsenic trioxide, or mixtures thereof.

3. The composition of claim 1 comprising in addition about 0.025 oz/gallon of potassium telluride.

4. An aqueous alkaline bath composition for electroplating a black metallic co-deposit on a platable substrate, comprising, in solution, about 1.0 oz/gallon of zinc oxide, about 1.0 oz/gallon of antimony oxide, and about 8.0 oz/gallon of sodium hydroxide.

5. The composition of claim 4 comprising in addition about 0.05 oz/gallon of polyethylene glycol.

6. An aqueous alkaline bath composition for electroplating a black metallic co-deposit on a platable substrate, comprising, in solution, about 1.0 oz/gallon of antimony oxide, about 0.5 oz/gallon of nickel cyanide, about 0.5 oz/gallon of sodium cyanide, and about 8.0 oz/gallon of sodium hydroxide.

7. The composition of claim 6 comprising in addition about 0.25 oz/gallon of potassium telluride, about 0.0125 oz/gallon of selenium dioxide, up to about 0.5 oz/gallon of lead subcarbonate, about 0.025 oz/gallon of arsenic trioxide, or mixtures thereof.

8. The composition of claim 6 comprising in addition about 0.025 oz/gallon of potassium telluride.

9. The composition of claims 1, 4, or 6 comprising in addition a brightener selected from the group consisting of the quaternary condensate of the reaction of nicotinamide and epichlorohydrin, the reaction product of polyethyleneimine and vanillan, propargyl alcohol, substituted imidazoline-type surfactants, and mixtures thereof.

10. An electroplating process for co-depositing a black metallic coating on a platable substrate, which comprises subjecting said substrate to an aqueous alkaline bath composition comprising, in solution about 1.0 oz/gallon of antimony oxide, about 1.0 oz/gallon of copper cyanide, about 1.7 oz/gallon of sodium cyanide, and about 8.0 oz/gallon of sodium hydroxide, at a voltage of about 2 volts, at a temperature of about 85° F. and at a current density of from about 1 to 80 amps/sq.ft., resulting in a black, co-deposited substrate.

11. The process of claim 10 wherein the bath composition comprises in addition about 0.025 oz/gallon of potassium telluride, about 0.0125 oz/gallon of selenium dioxide, up to about 0.5 oz/gallon of lead subcarbonate, about 0.025 oz/gallon of arsenic trioxide, or mixtures thereof.

12. The process of claim 10 wherein the bath composition comprises in addition about 0.025 oz/gallon of potassium telluride.

13. The process of claim 10 wherein the current density is from about 10 to 70 amps/sq.ft.

14. The process of claim 10 wherein the current density is from about 10 to 35 amps/sq.ft.

15. An electroplating process for co-depositing a black metallic coating on a platable substrate, which comprises subjecting said substrate to an aqueous alkaline bath composition comprising, in solution, about 1.0 oz/gallon of zinc oxide, about 1.0 oz/gallon of antimony oxide, and about 8.0 oz/gallon of sodium hydroxide, at a voltage of about 1.0 to 1.25, at a temperature of about 80° F., and at a current density of from about 0.5 to 40 amps/sq.ft., resulting in a black co-deposited coated substrate.

16. The process of claim 15 wherein the bath composition comprises in addition about 0.05 oz/gallon of polyethylene glycol.

17. The process of claim 15 wherein the current density is about 20 to 35 amps/sq.ft.

18. An electroplating process for co-depositing a black metallic coating on a platable substrate, which comprises subjecting said substrate to an aqueous alkaline bath composition comprising, in solution, about 1.0 oz/gallon of antimony oxide, about 0.5 oz/gallon of nickel cyanide, about 0.5 oz/gallon of sodium cyanide, and about 8.0 oz/gallon of sodium hydroxide, at a voltage of from about 2 to 3 volts, at a temperature of about 85° F., and at a current density of from about 0.5 to 80 amps/sq.ft., resulting in a black co-deposited coated substrate.

19. The process of claim 18 wherein the bath composition comprises in addition about 0.025 oz/gallon of potassium telluride, about 0.0125 oz/gallon of selenium dioxide, up to about 0.5 oz/gallon of lead subcarbonate, about 0.025 oz/gallon of arsenic trioxide, or mixtures thereof.

20. The process of claim 18 wherein the bath composition comprises in addition about 0.025 oz/gallon of potassium telluride.

* * * * *